United States Patent [19]

Demukai et al.

[11] Patent Number: 4,850,417

[45] Date of Patent: Jul. 25, 1989

[54] BENDABLE MULTIPLE WINDOW

[75] Inventors: Enzo Demukai, Higashi-osaka; Haruto Monobe, Wakayama, both of Japan

[73] Assignee: Nippon Door Check Mfg. Co., Ltd., Japan

[21] Appl. No.: 79,695

[22] Filed: Jul. 30, 1987

[30] Foreign Application Priority Data

Aug. 12, 1986 [JP] Japan ..... 61-24510[U]
Aug. 12, 1986 [JP] Japan ..... 61-124511[U]

[51] Int. Cl.[4] ..... E05D 15/26
[52] U.S. Cl. ..... 160/207; 160/90
[58] Field of Search ..... 160/206, 203, 90, 91, 160/207, 88, 94, 96, 114, 115, 186, 187

[56] References Cited

U.S. PATENT DOCUMENTS

| | | | |
|---|---|---|---|
| 1,757,048 | 5/1930 | Janeczko | 160/207 |
| 1,813,474 | 7/1931 | Ward | 160/207 |
| 2,155,116 | 4/1939 | Cox | 160/207 X |
| 2,330,696 | 9/1943 | Exiner | 160/207 X |
| 2,408,739 | 10/1946 | Dawes | 160/207 X |
| 2,771,133 | 11/1956 | Haskell | 160/207 X |
| 2,877,840 | 3/1959 | Hurowitz et al. | 160/91 |
| 2,879,841 | 3/1959 | Etten | 160/96 |
| 3,221,803 | 12/1965 | Lambert | 160/206 |
| 4,141,403 | 2/1979 | Church | 160/201 |
| 4,443,035 | 4/1984 | Saemann | 160/207 X |

*Primary Examiner*—Robert W. Gibson, Jr.
*Assistant Examiner*—David Purol
*Attorney, Agent, or Firm*—Barnes, Kisselle, Raisch, Choate, Whittemore & Hulbert

[57] ABSTRACT

An upper window and a lower window are bendably connected together within a window attaching framework of a building. The upper end of the upper frame is disconnectable from the lateral frames of the window attaching framework. When the upper window is disconnected from the lateral frames, the window openings increase. Thus, the window openings are suitable for use as emergency escape openings and improve ventilation efficiency.

2 Claims, 6 Drawing Sheets

BENDABLE MULTIPLE WINDOW

FIELD OF THE INVENTION

The present invention relates to a bendable multiple window comprising at least two windows connected together one above the other so that they can be opened and closed by being bent along the connecting region.

BACKGROUND OF THE INVENTION

Heretofore, the opening and closing of windows has been based selectively on either the swing system or the slide system. Particularly, windows used for high-rise buildings include some which are constructed so that they cannot be opened beyond a certain degree to prevent falling, but such arrangement has a problem that sufficient ventilation is impossible.

Thus, there has been developed a bendable multiple window comprising two windows, upper and lower, connnected together using hinges so that they can be opened and closed along the connecting region. In such bendable multiple window, when it is bent open, the upper end of the upper window slides downward along guides on the lateral frames of a window attaching framework.

In such arrangement, when the two windows are opened by being bent, the opening presents a triangle when the windows are viewed from the side, which triangle, because of its shape, cannot be used as an emergency escape opening in case of a fire or the like. Another problem is that the size of the opening is sometimes not sufficient depending on the degree of pollution of the air in the room.

DISCLOSURE OF THE INVENTION

An object of the invention is to provide a bendable multiple window adapted to be opened wide so as to provide an opening suitable for use as an emergency escape opening and make it possible to enhance ventilation depending upon the degree of pollution of the air in the room.

To achieve this object, a bendable multiple window according to the invention comprises:

- a window attaching framework attached to a building and having lateral frames,
- at least two windows connected together, one above the other, within the window attaching framework and bendable along the connecting region,
- of said two windows, the upper window being disconnectable at its upper end from the lateral frames of said window attaching frame work,
- the lower window being turnable at its lower end with respect to the lateral frames of the window attaching framework,
- said bendable multiple window having support means such as an arm interposed between the side of said upper window and the lateral frame of said window attaching framework.

According to this arrangement, when the opened window is viewed from the side, the opening is large enough to provide an emergency escape opening nad to improve ventilation efficiency. Further, the inside space of the opened window can be utilized for hanging out the washing to dry or suspending a flowerpot.

DESCRIPTION OF THE EMBODIMENTS

A first embodiment of the invention will now be described with reference to FIGS. 1 through 5.

Figure 1:
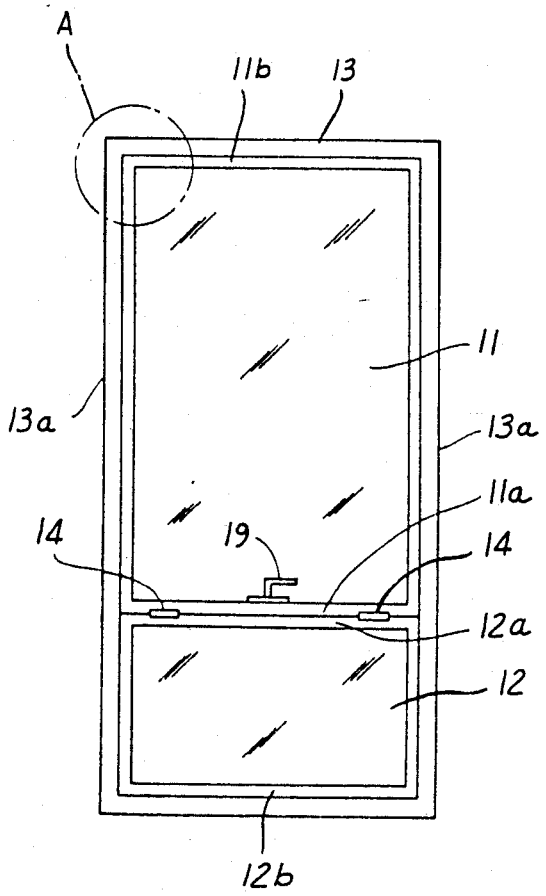
FIG. 1 is a front view schematically showing the arrangement of a first embodiment of a bendable multiple window of the present invention.
Figure 3:
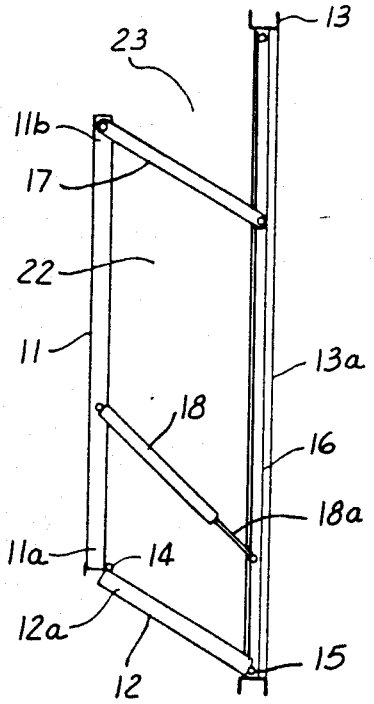
FIG. 3 is a side view showing a second opened state of the bendable multiple window of FIG. 1.
Figure 2:
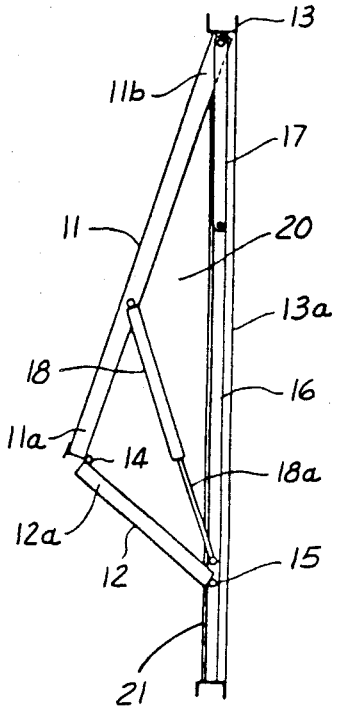
FIG. 2 is a side view showing a first opened state of the bendable multiple window of FIG. 1.

In FIGS. 1 through 3, the numerals 11 and 12 denote two windows, upper and lower, installed in a window attaching framework 13 of a building. The lower end frame 11a of the upper window 11 is bendably connected to the upper end frame 12*a* of the lower window 12 by hinges 14. The vertical dimension of the upper window 11 is greater than that of the lower window 12. The upper end frame 11*b* of the upper window 11 can be switched between a first state in which it is connected to the upper ends of the lateral frame 13*a* of the window attaching frame 13 so that it is turnable around a horizontal axis and a second state in which it is disconnected from the lateral frames 13*a*, (the details of which will be later described). The lower end frame 12*b* of the lower window 12 has guide rollers 15 attached to opposite sides thereof and fitted in guides 16 formed in the lateral frames 13*a* so that the lower end frame 12*b* is vertically movable and is turnable.

The numeral 17 denotes an arm for connecting the upper end of the upper window 11 to the associated lateral frame 13*a* of the window attaching framework 13. The opposite ends of the arm 17 are pivotally connected to the associated lateral side of the upper window 11 and to the associated lateral frame 13*a*. It is arranged such that the level of the connecting region between the arm 17 and the lateral frame 13*a* is lower than that of the upper end of the upper window 11 when the windows are opened with the upper end of the upper window 11 disconnected from the lateral frame 13*a*, as shown in FIG. 3. The numeral 18 denotes a damper which connects the lateral side of the upper window 11 at an intermediate position thereon to the lateral frame 13*a* of the window attaching framework 13 adjacent the lower end thereof. The damper 18 has a rod 18*a* urged to project outward. The level of the connecting region between the lateral frame 13*a* and the damper 18, as shown in detail in FIG. 2, is somewhat higher than that of the lower end of the lower window 12 in its raised position when the two windows 11 and 12 are bent open.

In the arrangement described above, with the upper end of the upper window 11 connected to the upper ends of the lateral frames 13*a*, when a handle 19 installed at the connecting region between the upper and lower windows 11 and 12 is gripped and pushed outward, said arm 17 will not operate, remaining parallel to the lateral frame 13*a*. In contrast, while the lower end of the lower window 12 is moving upward to a predetermined position along the guides 16, the upper and lower windows 11 and 12 are bent at the connecting region therebetween so that they are opened. At this time, the upper window 11 is forced outward by the damper 18, retaining the opened state shown in FIG. 2. In FIG. 2, openings 20, triangular as seen from the side, are defined at opposite sides, while an opening 21 is also defined below the lower window 12. The opened windows 11 and 12 shown in FIG. 2 can be closed by pulling the handle 19 while contracting the damper 18.

When it is desired to establish a greater opening than that shown in FIG. 2, the upper end of the upper window 11 is connected from the upper ends of the lateral frames 13*a* and then the upper and lower windows are outwardly pushed open by gripping the handle 19. Thereupon, as shown in FIG. 3, the upper window 11, subjected to an outward force from the damper 18, is moved open as it is supported adjacent its upper end by the arm 17. At this time, the lower end of the lower window 12, under the combined weight of the two windows 11 and 12, is outwardly turned with its lower end remaining in the lower position, while the upper window 11 is moved to a position parallel to its closed state. When the two windows 11 and 12 are opened as shown in FIG. 3, they are L-shaped as seen from the side, with wide openings 22 and 23 defined in continuous form in the right and left sides and in the upper end thereof. These openings 23 and 24 can be utilized as emergency escape openings and moreover they ensure quick and efficient ventilation particularly when the room air is considerably foul. When it is desired to close the windows 11 and 12 from the state shown in FIG. 3, the handle 19 is gripped and pulled.

Figure 4:
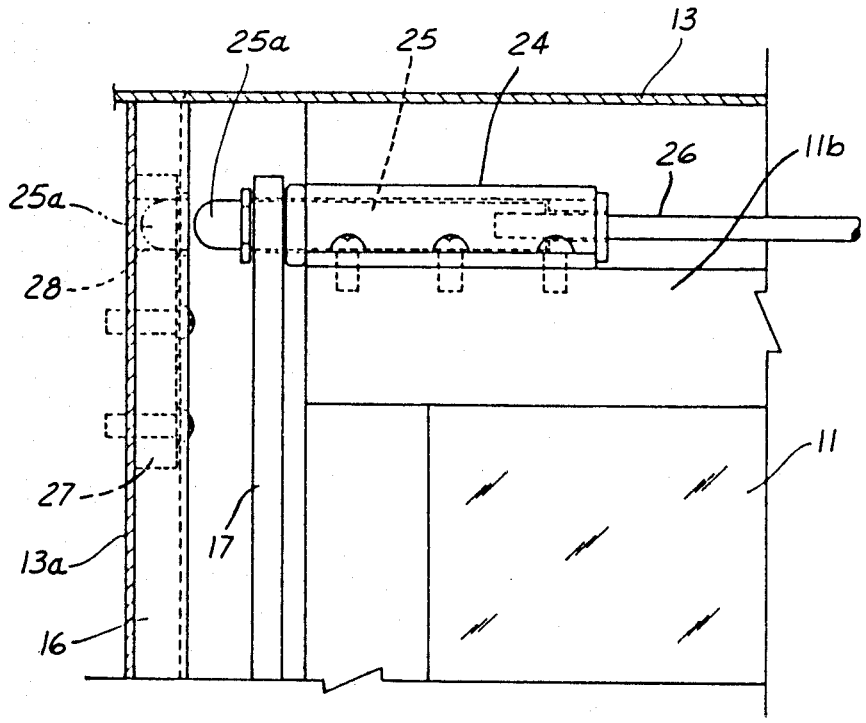
FIG. 4 is an enlarged front view of part A of FIG. 1 showing a switching mechanism.
Figure 5:
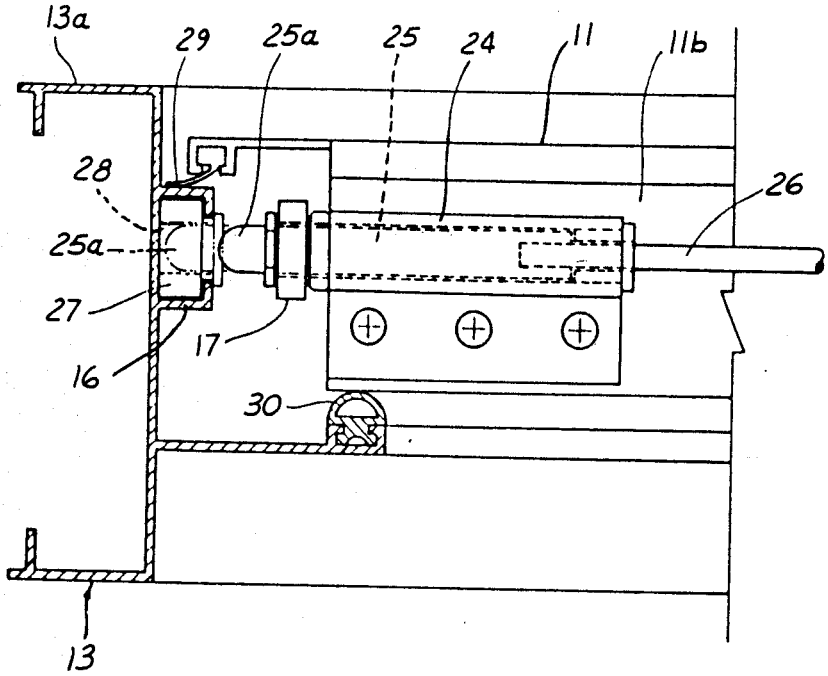
FIG. 5 is a plan view of the switching mechanism of FIG. 4.

The mechanism for switching the upper end frame 11b of the upper window 11 between the first state in which it is connected to the upper ends of the lateral frames 13a of the window attaching framework 13 and the second state in which it is disconnected therefrom is constructed in the manner shown in FIGS. 4 and 5. In FIGS. 4 and 5, in the opposite end regions (only one of which is shown) of the upper side of the upper end frame 11*b* of the upper window 11, a shaft attaching member 24 is fixed in position. Supported in the shaft attaching member 24 is a shaft 25 which is horizontally movable parallel to the upper end frame 11*b* and whose front end portion 25*a* projects laterally. Installed on the upper side of the upper end frame 11*b* is a rod 26 joined to the other end of the shaft 25 within the shaft attaching member 24 for moving the shaft 25 toward and away from the lateral frame 13*a* of the window attaching framework 13. It is arranged such that by moving the rod 26 horizontally, the front end portion 25*a* is fitted in and removed from a hole 28 formed in a bearing member 27 fixed in the guide 16.

As can be seen in FIGS. 4 and 5, the shaft 25 projecting out of the shaft attaching member 24 has one end of the arm 17 connected thereto. In FIG. 5, the numerals 29 and 30 denote packings for retaining watertightness in the closed state of the upper window 11.

A second embodiment of the invention will now be described with reference to FIGS. 6 and 7. Therein, the same members as those shown in FIGS. 1 through 5 are respectively denoted by the same numerals.

Figure 6:
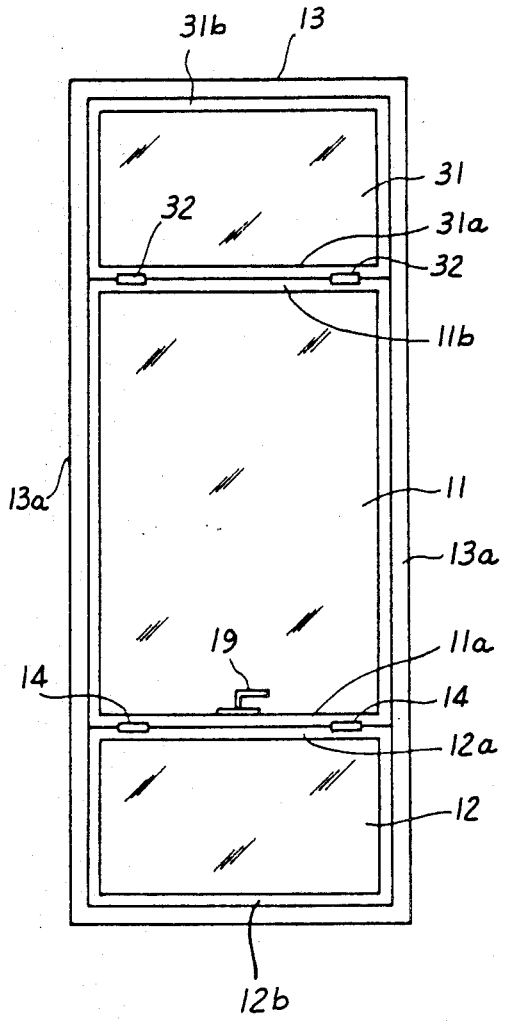
FIG. 6 is a front view schematically showing a second embodiment of a bendable multiple window according to the invention.
Figure 7:
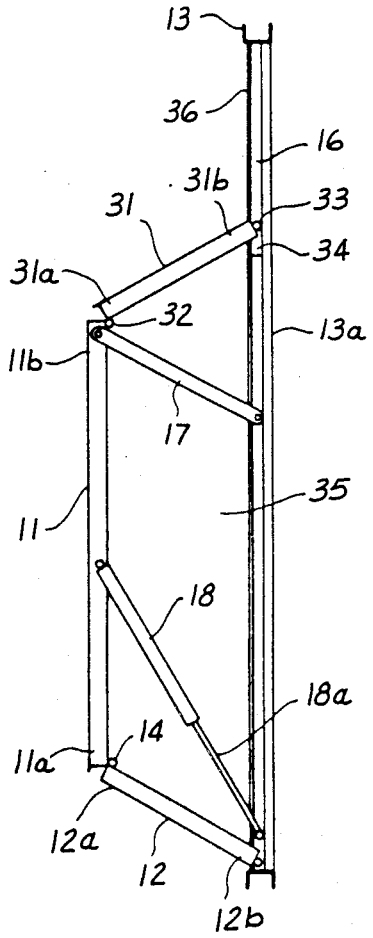
FIG. 7 is a side view showing the bendable multiple window of FIG. 6 in its opened state.

In FIGS. 6 and 7, an upper window 11 has a greater vertical dimension than that of a lower window 12, and its upper frame 11*b* has bendably connected thereto by hinges 32 the lower end frame 31*a* of a third window 31 which has the same vertical dimension as that of the lower window 12. The upper end frame 31*b* of the third window 31 has rollers 33 installed on its opposite sides and fitted in guides 16 formed in the lateral frames 13*a* of the window attaching framework 13 so that the upper end frame 31*b* is vertically movable and is turnable. The lower end frame 12*b* of the lower window 12 is pivotally supported at the lower ends of the lateral frames 13*a* of the window attaching framework 13. The numeral 34 denotes a stopper. When the roller 33 rests on the stopper, the lowering movement of the upper end of the third window 31 is stopped at the predetermined position.

In the above arrangement, when a handle 19 installed at the connecting region between the upper and lower windows 11 and 12 is gripped and pushed outward, the upper end of the third window 31 lowers along guides 16, while the upper window 11 moves parallel from its closed state for opening. At this time, the damper 18 is contracted, applying an outward force to the upper window 11. Thereby, the connecting region between the third and upper windows 31 and 11 and the connecting region between the upper and lower windows 11 and 12 are bent so that openings 35 which are trapezoidal as viewed from the side are defined at the opposite lateral sides. At this time, since the upper end of the third window 31 is lowered, an opening 36 is defined thereabove.

As shown in FIG. 7, the open state of the three windows 11, 12 and 31 is maintained by the arm 17 and damper 18. When it is desired to close the opened windows 11, 12 and 31, the handle 19 is gripped and pulled. Then, the three windows 11, 12 and 31 can be closed while extending the damper 18.

According to this embodiment, ventilation of the room can be effected by the openings 35 defined at the opposite lateral sides and the opening 36 defined at the upper end. The openings 35 at the opposite lateral sides are greater than conventional triangular openings so that ventilation efficiency is improved, and they can be utilized as emergency escape openings. Further, the inside space of the three opened windows can be utilized for hanging out the washing to dry or suspending a flowerpot.

This second embodiment is constructed so that the lower end of the lower window 12 will not rise or lower. However, it is possible to disconnect the lower end of the lower window 12 and raise the lower end frame of the lower window 12 so as to clean the outer surface of the window 12.

Figure 8:
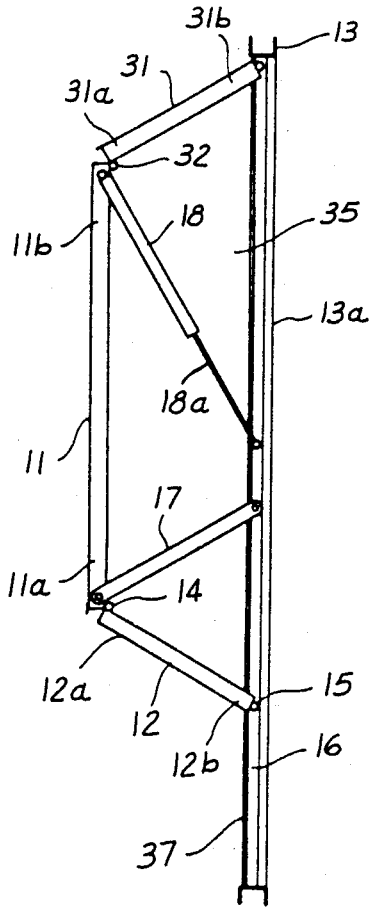
FIG. 8 is a side view of a third embodiment of a bendable multiple window according to the invention shown in its opened state.

A third embodiment shown in FIG. 8 will now be described. The third embodiment is an inverted version of the bendable multiple window of the second embodiment, with the damper 18 disposed between the upper end region of the lateral side of the upper window 11 and the lateral frame 13*a* and with the arm 17 disposed between the lower end region of the lateral side of the upper window 11 and the lateral frame 13*a*. In the case of this embodiment, an opening 37 will be defined below the lower window 12.

In the second and third embodiments described above, while the third and lower windows 31 and 12 are the same in vertical dimension, they may be made to differ in said dimension. Further, it is also possible to define upper and lower openings at the same time by upwardly and downwardly sliding the upper end of the third window 31 and the lower end of the lower window 12 when the windows are opened.

What is claimed is:

1. A bendable multiple window comprising:

a window attaching framework attached to a building and having parallel lateral frames, an upper window and a lower window, each having side portions, a top portion and a bottom portion and movable between open and closed positions relative to said window attaching framework, means pivotally connecting the bottom portion of said upper window to the top portion of said lower window, said upper and lower windows being disposed in the plane of said lateral frames in said closed position, means pivoting the bottom portion of said lower window to said lateral frames for outward pivotal movement, the top portion of said upper window being outwardly separable from said lateral frames, support arm means between said upper window and said window attaching framework, whereby, to move said windows to open position, said lower window can be pivoted outwardly and said upper portion of said upper window can be separated outwardly and supported in said outwardly separated position by said support arm means, and a third window having a top portion and a bottom portion, the bottom portion of said third window being pivotally connected to the top portion of said upper window and the top portion of said third window being pivotally, slidably connected to the lateral frames of said window attaching framework.

2. A bendable multiple window comprising:

a window attaching framework attached to a building and having parallel lateral frames, an upper window and a lower window, each having side portions, a top portion and a bottom portion and movable between open and closed positions relative to said window attaching framework, means pivotally connecting the bottom portion of said upper window to the top portion of said lower window, said upper and lower windows being disposed in the plane of said lateral frames in said closed position, means pivoting the bottom portion of said lower window to said lateral frames for outward pivotal movement, the top portion of said upper window being outwardly separable from said lateral frames, support arm means between said upper window and said window attaching framework, whereby, to move said windows to open position, said lower window can be pivoted outwardly and said upper portion of said upper window can be separated outwardly and supported in said outwardly separated position by said support arm means, the pivoted bottom portion of said lower window being vertically movable with respect to the lateral frames of said window attaching framework, and a third window having top and bottom portions, the bottom portion of said third window being pivotally connected to the top portion of said upper window and the top portion of said third window being pivotally connected to the lateral frames of the window attaching framework.

* * * * *